United States Patent [19]

Guth

[11] 4,383,622

[45] May 17, 1983

[54] SANITARY WASHBOTTLE KIT ASSEMBLY

[76] Inventor: Durward O. Guth, 24-B N. Ardmore Ave., Villa Park, Ill. 60181

[21] Appl. No.: 241,678

[22] Filed: Mar. 9, 1981

[51] Int. Cl.[3] ..... B65D 39/16

[52] U.S. Cl. ..... 222/209; 222/401; 222/395

[58] Field of Search ..... 222/206, 209, 394, 395, 222/478, 544, 545, 400.8, 401

[56] References Cited

U.S. PATENT DOCUMENTS

| | | | |
|---|---|---|---|
| 688,544 | 12/1901 | Pitts | 222/209 |
| 929,990 | 8/1909 | Shields | 222/209 |
| 2,431,596 | 11/1947 | Wickstrum | 222/209 |
| 2,598,869 | 6/1952 | White | 222/209 |
| 3,430,817 | 3/1969 | Falkenberg | 222/209 X |
| 4,015,753 | 4/1977 | Bennett | 222/209 X |
| 4,043,341 | 8/1977 | Tromovitch | 222/209 X |
| 4,245,788 | 1/1981 | Wright | 222/206 X |

*Primary Examiner*—Joseph J. Rolla
*Assistant Examiner*—Jan Koniarek
*Attorney, Agent, or Firm*—A. A. Saffitz

[57] ABSTRACT

An improved sanitary washbottle kit assembly comprising a specially shaped molded two piece dispensing and sealing stopper equipped with a dispensing tube and resilient bulb adjacent the neck of the flask of the washbottle. The molded two piece dispensing and sealing stopper is formed of resilient compressible material, one piece being an outer piece which covers the open top of the flask extending downwardly over the neck and is shaped with a projecting ledge at a height a short distance below the top of the flask to form a horizontal channel extending between the outside of the flask and the inside of the flask while the second piece is a molded inner stopper formed with a flange fitting into a counterbore of the outer stopper, this flange counterbore interfitting providing a single compressible resilient closure unit. The inner stopper piece may be adhered by adhesive to the inner stopper piece. An inner passageway portion is created within the flask by the conformation of the wall of the inner stopper piece below the projecting ledge of the outer stopper piece so that a passageway in the shape of an inverted U with a horizontal bridge portion located just below the top of the flask extends downwardly on the outside of the flask as well as on the inside thereof. The passageway on the outside of the flask in the outer piece ends in a T, the bottom opening of the T communicating with the bulb and the side of the T adapted to be closed by a finger in order to dispense liquid when pressure is applied by the bulb.

4 Claims, 7 Drawing Figures

Fig. 1
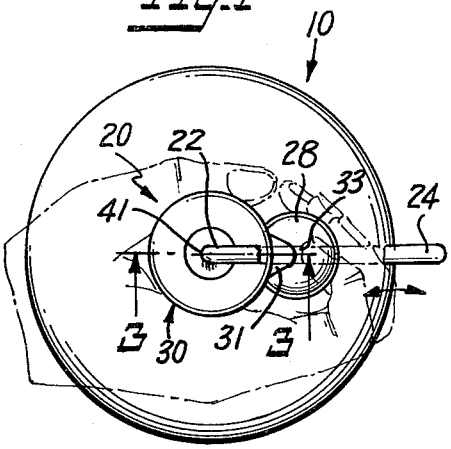
Fig. 3
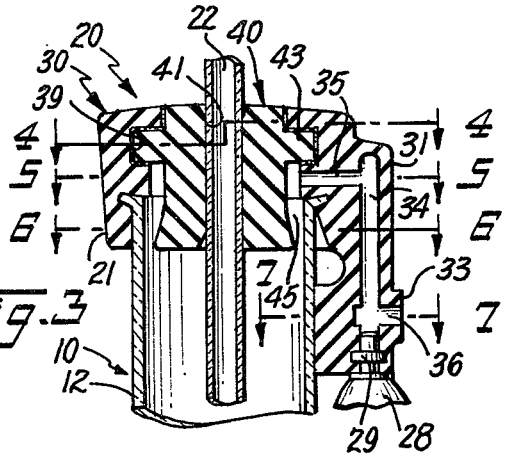
Fig. 2
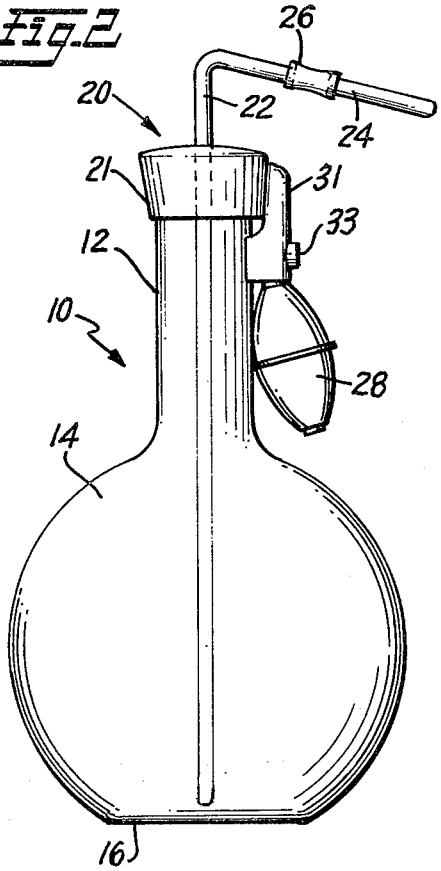
Fig. 4
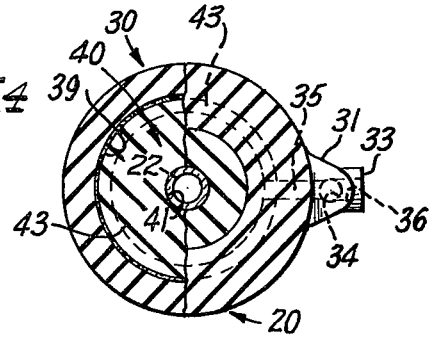
Fig. 5
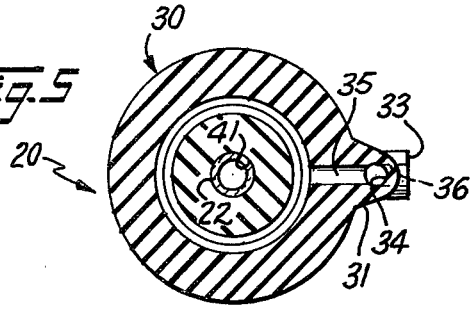
Fig. 6
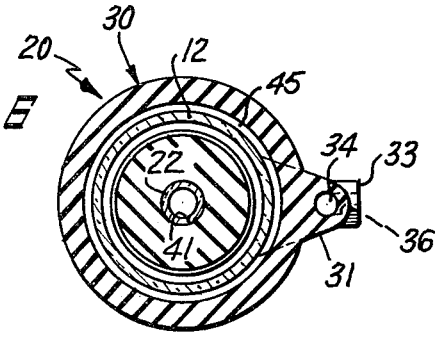
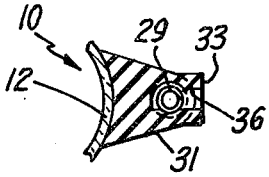
Fig. 7

SANITARY WASHBOTTLE KIT ASSEMBLY

BACKGROUND OF THE INVENTION

1. Field of the Invention

This invention is in the field of liquid dispensing devices of the resilient wall type wherein the resilient wall is part of a fluid pressure generating bulb, is removable from the container to be part of a kit or assembly for the container and whenever the fluid pressure causes the dispensing operation to take place emits liquid held in the container through an outlet tube. The invention is also in the field of compressible resilient closures for flasks wherein the closure is of the stopper type and is provided with separate inlet and outlet passages.

2. Description of the Prior Art

Washbottles of the conventional type have been used in the teaching of laboratory chemistry and analytical chemistry for a long time, an example of the use of a washbottle for the intermittent delivery of fluids being shown in MacLean, U.S. Pat. No. 1,600,189 granted Sept. 14, 1926.

Washbottles utilizing a replaceable bulb as pump to bring pressure into a washbottle, rather than using the mouth of the user are generally regarded as washbottles of the sanitary type and an example of this type of washbottle is disclosed in U.S. patent to Severson U.S. Pat. No. 2,105,957 granted Jan. 18, 1938.

Squeeze bulb dispensers such as used in automatic burettes shown in Geyer, U.S. Pat. No. 1,993,001 granted Mar. 5, 1953, or in pipettes as disclosed in Sharples, U.S. Pat. No. 553,044 granted Jan. 14, 1896, have employed T tubes or open tubes in order to permit the control of liquid dispensing under pneumatic pressure.

However, in all of the prior art patents, the stopper or closure through which the open or T tube is fitted in order to pressurize the liquid contents of the flask has been a one piece stopper either of the complex blown glass shape as in Geyer or of the specialized glass shape shown in Sharples. The expense of these blown glass closures makes these laboratory devices prohibitive in cost for most chemistry classes while breakage and replacement is a serious problem.

The two piece closure in Perelson, U.S. Pat. No. 2,342,215 granted Feb. 22, 1944, is specifically adapted to hold a needle forming a passageway to fill a hypodermic syringe but there is no concept of a low cost compressible rubber stopper as in Severson U.S. Pat. No. 2,105,959 to permit a simple finger manipulation for dispensing liquid utilizing the stopper or closure for all of the passageway structure on the outside as well as the inside of the flask to thereby control dispensing and avoid the expense of the glass stopper in Geyer or the complex glassware in Sharples and Geyer.

It is surprising to find that a simple two piece closure with inverted U passageway in accordance with the invention can improve the efficiency of assembly and manufacture of a sanitary washbottle while reducing the cost over that of the single stopper heretofore used as in Severson U.S. Pat. No. 2,105,957.

OBJECTS OF THE INVENTION

An object of the invention is to provide an improved sanitary washbottle kit assembly for a resilient wall removable bulb pump to improve the efficiency of manufacture and reduce the cost by forming inner and outer closure members designed to cooperate to form an inverted U air passageway from the outside of the flask to the inside of the flask which lies wholly within the two piece closure connected as a unit to both the flask and the bulb.

A further object of the invention is to provide an improved liquid dispensing washbottle kit assembly comprising bulb and closure wherein the closure is made of two piece compressible resilient material such as natural or synthetic rubber cured, shaped and molded to form an inverted U passageway for air between the outside and inside of the flask and fitted with a T connection at the outside to permit finger control of dispensing.

Still further and other objects will become apparent from the following description, accompanying drawings and claims.

SUMMARY OF THE INVENTION

An improved liquid dispensing kit assembly for a removable bulb type washbottle or flask comprising a two piece compressible resilient closure which is assembled together to form a unit comprising an inverted U shaped passageway from the outside of the flask to the inside of the flask, the outer leg of the inverted U being fitted with connecting means for pneumatic connection to the bulb which is juxtaposed to the neck of the flask and immediately adjacent thereto a T fitting having an opening permitting the pump to pressurize the liquid contents of the flask. The two pieces of the closure unit are assembled together and the air passageway of the inverted U shape is substantially uniform throughout the distance between the bulb inlet on the outside of the flask to the outlet at the other end in the interior of the flask. The inner and outer pieces comprising the stopper, e.g., the piece within the flask and the cover piece over the top and on the outside of the flask are positioned together on the borosilicate tube which holds them together in the proper position so that parts are aligned. The thicknesses of the two stoppers permit their easy passage over the bend of the borosilicate tube which results in a sturdy structure when placed in the neck of the washbottle. Because of the capability of accurately molding apparatus for cured elastomer, synthetic or natural rubbers and because of the greater simplicity of molding two pieces accurately as compared with a single piece, surprising savings in cost result with substantially no rejects in manufacture. This results in greater efficiency at lower cost and is a direct benefit to education in laboratory science.

BRIEF DESCRIPTION OF THE DRAWINGS

FIG. 1 is a plan view of a washbottle with a two part stopper according to the present invention, the hand is shown in phantom lines to illustrate the utility of the invention;

FIG. 2 is an elevational view of the washbottle of FIG. 1;

FIG. 3 is an enlarged fragmentary vertical sectional view, taken on the line 3—3 of FIG. 1;

FIG. 4 is a horizontal sectional view, taken on the line 4—4 of FIG. 3;

FIG. 5 is a horizontal sectional view, taken on the line 5—5 of FIG. 3;

FIG. 6 is a horizontal sectional view, taken on the line 6—6 of FIG. 3; and FIG. 7 is a fragmentary horizontal sectional view, taken on the line 7—7 of FIG. 3.

DESCRIPTION OF THE PREFERRED EMBODIMENT

The preferred embodiment illustrated in the Figs. of the drawings herein is the kit which fits the ISO standard 500 ml flat bottom boiling flask having 34.90 mm to 37.45 mm OD lips but the kit of the invention is adapted to fit other size boiling flasks as well such as the 1,000 ml flask for example which is available in its own standard size.

The assembly kit as shown in FIGS. 1 and 2 fits into a washbottle 10, into the neck 12 of which the two piece closure assembly 20 is fitted. The two piece closure assembly 20 fits over the open top of the washbottle 10 and extends downwardly along the sides 12 of the washbottle 10 which is of the type having the round bulb wall 14 and flat bottom 16.

Through the central aperture of the two piece closure there is fitted the tube 22 which extends almost to the bottom of the inside of the flask 10 as shown in FIG. 2. The connector 26 (clear rubber or plastic) joins the outer end of tube 22 to the tip 24 from which a stream of fluid exits when pneumatic pressure is applied by pressing bulb 28 and covering the aperture of 33 with a finger.

In the example of the sub-assemblies of closure 20, tube 22, connector 26, tip 24, the 500 ml flask which is utilized as a glass bottle 10 may be a Corning Pyrex catalog No. 4060 into which is fitted an 18 mm length of flexible tubing which has a tip 24 which is 6 mm in length and has a bent delivery tube which is also 6 mm in length (see FIG. 2). Obviously 750 ml, 1000 ml etc., may be used. Nonflexible connector tubing may be used also.

Both inner and outer pieces making up the closure 20 are made of a suitable cured elastomer which conforms to the accepted commercial specification for hardness, e.g., from about 45 up to 50 on the Shore Durometer A2 scale. Examples of suitable elastomers are natural rubber, GRS, neoprene, Buna N and EPDM. Cured molded elastomers are capable of being molded to great accuracy and the unique structural configuration and these can be cured by known methods to provide the precise physical properties required for the two parts of the stopper. These known methods of curing elastomer stock for precision molding are described in the text "Vulcanization of Elastomers", Alliger and Sjothun Reinhold Publishing Co. 1964.

The 500 ml embodiment illustrated in FIG. 2 herein is adapted to be used to dispense hot washing liquid by a singlehanded operation, the flask containing liquid being placed on a hot plate for heating. On heating the working assembly is easily and quickly removed using a single hand. Water can be boiled in the flask without building undesirable pressure, yet is available for washing by simply repositioning the assembly in the flask. The flask is adapted to be used with insulation around the neck. Assembly or reassembly of the closure into the flask is easily accomplished by supporting the flask 10 in a firm support (table top or pad) placing the two piece closure cap 20 into the flask lip and exerting downward pressure to snap the cap 20 into place thereby putting the washbottle into condition for use. If desired, a tiny amount of lubricant can be put on the interior of the cap to expedite assembly. Pure glycerine or Dow Corning stopcock grease are effective.

As shown in FIGS. 3–7 inclusive, the two piece stopper assembly comprises an outer housing 30 which serves to cover the outer lip of the flask 10 and to extend therebelow at the skirt 21 and an innter housing 40, the innter housing 40 being formed with a flange 43 precisely dimensioned to snap-fit within a counterbore 39 of the outer housing 30. The dimensioning of the outer housing 30 and its co-acting snap fitting inner housing 40 is such that the juxtaposed parts 30 and 40 when snap-fitted together provide a continuous and unbroken top surface of the stopper assembly 20 which is best seen in FIG. 3.

A central opening 41 is provided within the inner housing 40 to receive tubing 22 the opening 41 being slightly flared or countersunk at the bottom and the top of the surfaces of the inner housing 40 to facilitate penetration by tube 22. Entry of the tube may be facilitated by a tiny amount of lubricant as is described above for assembly and reassembly portions.

A critical feature of the invention is the structural relationship of the depending leg portion 31 of the outer housing 30. It is seen from the views in FIGS. 3 and 4 that the depending leg portion is below the top surface of the two piece stopper 20 and that the depending leg portion is provided with an upper horizontal passage 35 which constitutes the bridge of an inverted U passageway, the one leg of the U constituting the vertical passage 34 which exits in a T at the very bottom portion of the depending leg, the T having an opening 36 which is a port covered by the finger at the time that the bulb 38 is squeezed and the continuation of vertical passage 34 being fitted with connector 29 which connects the bulb to the outer vertical passage 34 of depending leg 31. The inner vertical passage section of the inverted U shaped passageway is air passageway 45 and is much shorter in its extent or height than is the outer vertical passageway which is connected to the bulb 28. The outwardly tapered wall of the inner housing 44 forms part of this inner passage while the other part is formed at the very top by the right angled connection to the upper horizontal passageway. The lower portion of the passageway 45 is provided by the inner surface of the neck of the flask 10.

It was surprising to the inventor to discover after the initial design and molding portions were carried out to form the new closure assembly of inner and outer housings to make economies of between 10–20% in the cost of manufacturing in a time when costs are increasing and productivity is decreasing.

In the original one piece stopper arrangement it was necessary to come up with passageways which were cut or machined. The original one piece rubber cap was not produced in two parts so that it could be later assembled to produce a finished working cap. Machining rubber is not easy. It is laborious, time consuming, results in many rejected parts, and greatly increases production cost.

This unsatisfactory situation has existed ever since the present washbottle was placed on the market. Yet no one has come up with a design that eliminated the expensive machining operations.

A further advantage was discovered in the present construction in which the passageway in from the aspirator bulb to the inside of the washbottle is also connected with a side port that in normal use is covered with a finger. This port when uncovered either by lifting the finger or by removing the whole hand, assures that the pressure within the washbottle is the same as the surrounding atmosphere, unless of course, that some artificial situation, such as boiling water in the washbottle, produces gas (steam) faster than the port can relieve the pressure. This assures that the standing idle wash-bottle does not drip with changes of barometric pressure. This last additional advantage of single handed operation and assurance of no drip with changes of barometric pressure provides an assurance of efficiency of operation without rejecting a part of production that does not come up to the standards required.

What is claimed is:

1. An improved two part stopper constituting a wash-bottle kit assembly adapted for introducing tubing extending to the bottom of a flask whereby pressurized liquid passes up said tubing and out of the outlet of said tubing, said assembly comprising:

an apertured outer stopper housing formed with a depending leg which lies below the top of said outer housing to extend along the neck of the flask and is contoured to fit against said neck on the outside of said flask and below the lip thereof;

said depending leg provided with a vertical passageway extending therethrough which is connected at the one end to a bulb;

said depending leg provided at the other end remote from said bulb with a horizontal passageway which forms a bridge for air pumped by said bulb through said vertical passageway into said flask;

an inner stopper housing formed with a projecting flange adapted to snap-fit into a corresponding counterbore of said outer stopper housing and to form a common top surface therewith when assembled in the aperture thereof;

said outer stopper housing having a counterbore for snap-fitting with the projecting flange of said inner stopper housing;

said inner stopper housing being tapered at its bottom and providing a passageway below said flange between the tapered sides of said inner stopper housing and the inner wall of the neck of the bottle for pressurized air from said bulb to compress the liquid in said flask; and a central bore in said inner stopper housing for receiving the tubing which is bent at its outlet.

2. The invention of claim 1 wherein said horizontal passageway and said vertical passageway in said leg have substantially the same diameter.

3. The invention of claim 2 wherein said inner housing stopper is spaced inwardly from the inner wall of said flask below said flange by a distance approximately equal to the diameter of said vertical passageway in said depending leg.

4. The invention of claim 2 wherein said vertical passageway connects to a T with a side opening adapted to be closed by a finger and the bottom opening connecting a bulb which dispenses liquid when the side opening is closed.

* * * * *